United States Patent [19]

Garland et al.

[11] Patent Number: 5,012,601

[45] Date of Patent: May 7, 1991

[54] PICTURE FRAME ASSEMBLY

[76] Inventors: John R. Garland, 1 S. 045 Spring Rd., Oak Terrace; Melvin L. Thomas, 550 N. Biermann, Villa Park, both of Ill. 60181

[21] Appl. No.: 291,060

[22] Filed: Dec. 28, 1988

[51] Int. Cl.[5] ..... A47G 1/06; G09F 1/12

[52] U.S. Cl. ..... 40/152; 40/152.1; 40/156

[58] Field of Search ..... 40/152.1, 152, 155, 40/154, 156

[56] References Cited

U.S. PATENT DOCUMENTS

| | | | |
|---|---|---|---|
| 2,579,886 | 5/1971 | Hughes | 40/152 |
| 3,782,015 | 1/1974 | Esry | 40/152 |
| 4,157,624 | 6/1979 | Sobel | 40/155 |
| 4,496,127 | 1/1985 | Nelson | 40/152.1 |

FOREIGN PATENT DOCUMENTS

| | | | |
|---|---|---|---|
| 2313034 | 9/1974 | Fed. Rep. of Germany | 40/152 |
| 2114884 | 9/1983 | United Kingdom | 40/152 |

*Primary Examiner*—Kenneth J. Dorner
*Assistant Examiner*—J. R. Hakomaki
*Attorney, Agent, or Firm*—Welsh & Katz, Ltd.

[57] ABSTRACT

A picture frame assembly comprising an outer frame member and an inner frame member which is releasably secured to the outer frame member so that it can be snapped in and out of engagement for quickly and easily changing a framed picture unit.

6 Claims, 1 Drawing Sheet

PICTURE FRAME ASSEMBLY

BACKGROUND OF THE INVENTION

The present invention relates to a picture frame, suitable for use in framing photographs, paintings, and the like. The present invention relates, in particular, to a picture frame assembly which can releasably secure a picture unit within the picture frame assembly and thereafter allow replacement of the original picture unit with a new picture unit with improved ease and effectiveness.

Picture frames are well known in the art. Wooden frames generally hold a picture unit with brads or small nails which are pounded into the back of the frame to securely hold the picture unit within the frame for display. Metal frames may have metal tabs on the back of the frame for securing a picture unit within the metal frame.

The picture unit will include the image sheet which is to be displayed plus a backing sheet or a backing board. Some picture units will also include matting which provides a clean border of white or another solid (single) color in order to border and thus emphasize the image sheet being displayed. In some cases more than one matting sheet may be used in contrasting colors. The image sheet being displayed may be a photograph, painting, water color, print, poster and the like.

In addition, the picture frame may hold a pane of glass which covers the picture unit for protection. The glass keeps the image sheet free from atmospheric dust and free from dirt or oil such as is normally found on the hands of a viewer of the picture unit or a person handling the framed picture unit.

It is often desired to replace the picture unit within the frame with a new picture unit. For wooden frames, this is accomplished by removing the brads or nails. For metal frames this is accomplished by bending the metal tabs up and away from the backing sheet or backing board of the picture unit. After the new picture unit is put in place in a wooden frame, brads or nails are pounded back into the wooden frame to secure the picture unit in place. After the picture unit is put in place in a metal frame, the tabs of the metal frame are bent downwardly against the backing sheet or board to secure the picture unit within the frame.

A disadvantage within wooden frames is that pounding brads or nails into the wood is tedious and often leads to bent nails or brads and bruised thumbs when the tack hammer strikes the nail obliquely or misses the nail completely to strike the user's hand. A disadvantage with metal frames having metal tabs is that bending the metal tabs to change the picture unit cold works the metal and makes it brittle. Accordingly, metal tabs may soon break off and the frame will thereby eventually become unusable.

Accordingly, it is an object of the present invention to provide a picture frame which does not require the use of brads or nails.

It is a further object of the present invention to provide a picture frame which does not require metal tabs for holding a picture in place.

It is a particular object of the present invention to provide an improved picture frame which is capable of releasably securing a picture unit in a manner which makes replacement of the picture unit within the frame quick and easy with a minimum of effort.

These and other objects of the present invention, as well as the advantages thereof, will be readily ascertained from the disclosure which follows.

SUMMARY OF THE INVENTION

The foregoing objects of the present invention may be achieved by a picture frame assembly, which is suitable for framing photographs or paintings and the like, which comprises an outer frame member and an inner frame member. The outer frame member has a peripheral sidewall to encompass a framed picture unit and it has a peripheral face for covering the outer circumferential portion of a framed picture unit. The inner frame member is sized and shaped to fit within the peripheral sidewall of the outer frame member, and it has a peripheral sidewall as well as a peripheral face for pressing a framed picture unit against the back of the peripheral face of the outer frame member. The picture frame assembly also includes a plurality of gripping means between the inside surface of the peripheral sidewall of the outer frame member and the outside surface of the peripheral sidewall of the inner frame member, for releasably securing the inner frame member to the outer frame member when the inner frame member is fit within the outer frame member to hold a picture unit therebetween.

The present invention also comprehends a picture frame assembly which includes the aforesaid outer frame member as hereinabove defined as well as the inner frame member as hereinabove defined. In this embodiment there is a plurality of first gripping means spaced about the inside surface of the peripheral sidewall of the outer frame member. In addition, there is a plurality of second gripping means spaced about the outside surface of the peripheral sidewall of the inner frame member, the second gripping means being sized and shaped to releasably grippingly engage the first gripping means, and the second gripping means being positioned on the inner frame member to releasably grippingly engage the first gripping means on the outer frame member when the inner frame member is fitted within the outer frame member, whereby a picture unit may be releasably secured between the inner and outer frame members.

In a particularly preferred embodiment of the picture frame assembly as defined in the immediately preceding paragraph, the first gripping means comprises a plurality of sets of elongated gripping teeth spaced about the inner surface of the peripheral sidewall of the outer frame member, each set of elongated gripping teeth containing a plurality of gripping teeth on the inner surface of the sidewall in longitudinal alignment with the edge of the peripheral sidewall and positioned in side-by-side orientation. In addition, the second gripping means comprises a plurality of sets of elongated gripping teeth spaced about the outside surface of the peripheral sidewall of the inner frame member, each set of elongated gripping teeth containing a plurality of gripping teeth on the outer surface of the sidewall in longitudinal alignment with the edge of the peripheral sidewall and positioned in side-by-side orientation. Each set of gripping teeth on the inner frame member is located to engage an equivalent set of gripping teeth on the outer frame member in gripping engagement, thereby to secure a picture frame unit between the inner and outer frame members.

In addition, a picture frame assembly according to the present invention includes a plurality of tabs spaced about the inner surface of the peripheral sidewall. The tabs project from the inner surface and have a serrated edge which provides a means by which the picture frame assembly may be mounted on a nail or other hanger device which projects from a wall on which the frame is to be hung. The tab also provides a means by which the inner frame member may be gripped to cause the release of the inner frame member from the outer frame member in order to remove the inner frame member and thereby enable the changing of the picture unit.

A clearer understanding of the present invention may be obtained from the disclosure which follows when read in light of the accompanying figures.

DESCRIPTION OF THE PREFERRED EMBODIMENT

Figure 1:
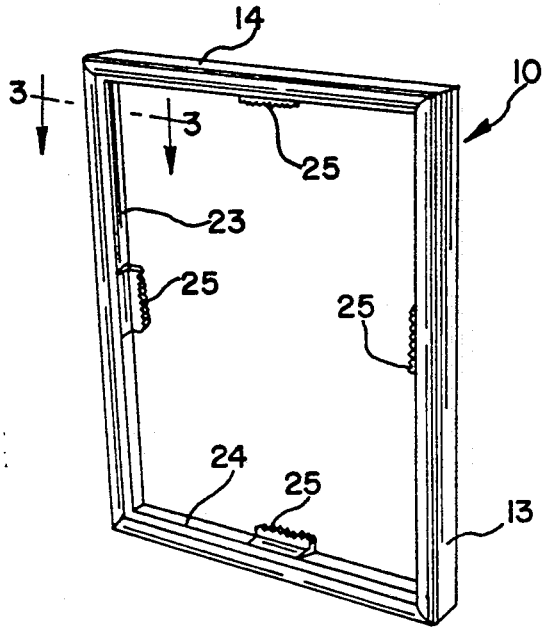
FIG. 1 is a perspective view of the picture frame assembly of present invention.
Figure 2:
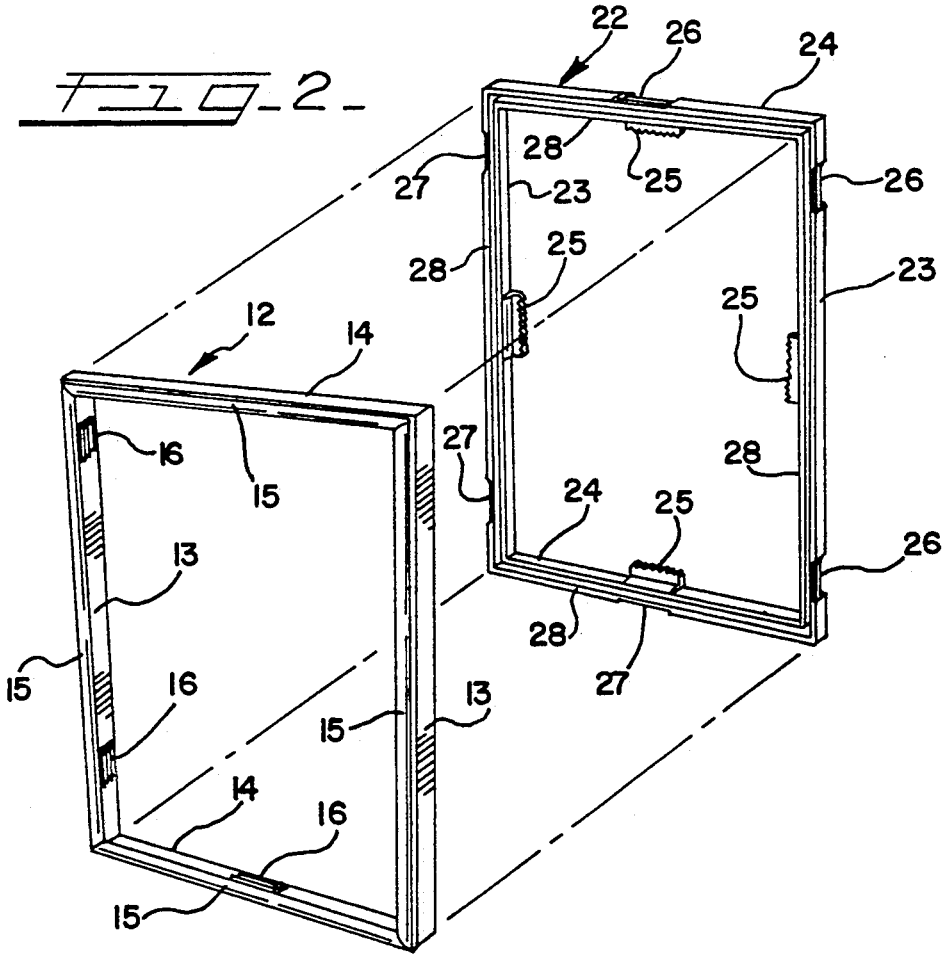
FIG. 2 is an exploded perspective view of the picture frame assembly of FIG. 1, wherein the inner frame member and the outer frame member are shown separated.

The structure of one embodiment of the picture frame assembly of the present invention is set forth in FIG. 1 and FIG. 2. FIG. 1 discloses a picture frame assembly 10 having a generally rectangular shape. The picture frame assembly comprises an outer frame 12 (FIG. 2) having a rectangular shape and a rectangular inner frame 22 (FIG. 2) which fits inside of the outer frame.

Referring now to FIG. 2, it will be seen that the outer frame 12 has two long sidewalls 13 and two short sidewalls 14 which make up the generally rectangular shape. A rounded face 15 is found on the front of the outer frame member. This rounded face 15 is more clearly seen in FIG. 3, which will be discussed hereinafter. The outer frame member 12 has a plurality of gripping teeth 16 located on the inside of the sidewalls 13 and 14. Each long sidewall 13 has a pair of sets of gripping teeth 16. One set of teeth 16 is located near the bottom corner and one is located near the top corner of the outer frame member 12 on each long sidewall 13. Additionally, the short sidewalls 14 of the outer frame member 12 contain a single set of gripping teeth 16 which is generally centrally located. Gripping teeth 16 are in longitudinal alignment with the edge of the peripheral sidewalls 13 and 14 and positioned as a row of teeth.

The inner frame member 22 has long sidewalls 23 and short sidewalls 24 which are dimensioned so that the inner frame member 22 can fit snugly within the sidewalls of the outer frame member 12. The inner frame member includes a number of sets of gripping teeth 26 which are designed to engage the gripping teeth 16 of the outer frame member in a releasably secured grip. The long sidewalls 23 of the inner frame member 22 have a pair of sets of gripping teeth 26. One set of gripping teeth 26 is located on the outside of the sidewall 23 near the upper corner and the other set of gripping teeth 26 is found on each sidewall 23 near the lower corner. In addition, the short sidewalls 24 each have a set of gripping teeth 26 which is centrally located on the outside of the sidewall 24. Gripping teeth 26 are in longitudinal alignment with the edge of the peripheral sidewalls 23 and 24 and positioned as a row of teeth.

It will be noted that the gripping teeth 26 in each instance are contained in a recess 27 which appears in the outer surface of the sidewalls 23 and 24. The gripping teeth 26 are projected from the bottom of the recess 27 so that the point of the teeth 26 becomes coplanar with the outside surface of the sidewalls 23 and 24. This means that the gripping teeth 16 of the outer frame member will "snap into" the gripping teeth 26 of the inner frame member and into the recess 27 to provide a releasably secured engagement which gives the inner frame member a snug fit within the outer frame member.

FIG. 2 also shows that inner frame member 22 has a tab 25 projecting inwardly from each of the four sidewalls 23 and 24 and terminating in a serrated edge. The serrated edge provides a means by which the picture frame assembly can be hung on a nail or other hanger device projecting from a wall. Each sidewall contains one tab 25 centrally located on the inside of the sidewall.

Figure 3:
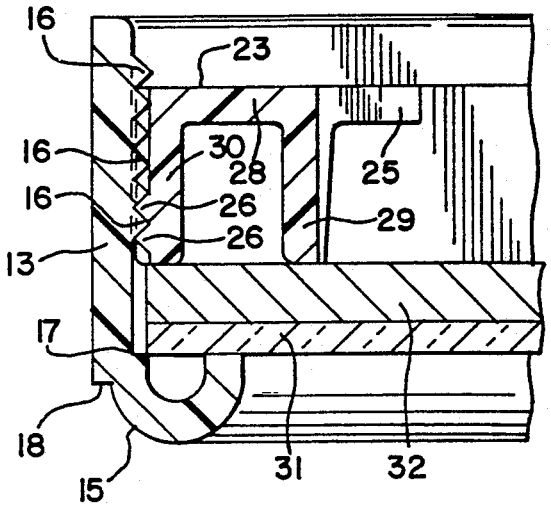
FIG. 3 is a cross-sectional view of the picture frame assembly of FIG. 1 taken along section line 3—3.

FIG. 3 provides a cross-sectional view of the picture frame assembly 10 which has been taken along the section line 3—3 of FIG. 1. It will be seen that the outer frame member has the plurality of gripping teeth 16 which in this instance consists of six gripping teeth on the inside of long sidewall 13. The outer frame member also has the rounded front face 15. The front face 15 provides a means for encompassing the outer circumference of a picture unit 32 which is confined between the back of the outer face 15 and the front of long sidewall 23 of the inner frame member. It will be seen that the inner frame member 22 has a sidewall structure which is channel shaped. The web 28 of the channel is spaced away from the back of a picture unit 32 so that the inner leg 29 and the outer leg 30 provide a face which acts to push against the picture unit 32 and hold it against the back of the face 15 of the outer frame member in order to secure the picture unit tightly in place. A pane of glass 31 is also shown in FIG. 3, as is conventional in many picture frame units. The sidewall 23 of the inner member will be seen to contain only two teeth 26 projecting from the outer leg 30, although one tooth could be sufficient.

It will be seen that the gripping teeth 16 are in longitudinal alignment with the peripheral sidewall 13 and positioned in vertical orientation, one above the other. It will also be seen that the gripping teeth 26 are in longitudinal alignment with the peripheral sidewall 23 and positioned in vertical orientation, one above the other.

In addition, the inside of the sidewall 23 also has the pad or tab 25 projecting inwardly from inner leg 29. The pad or tab 25 is coplanar with the outside surface of the web 28 of the long sidewall 23 of the inner frame member 22. This pad 25 has the serrated edge (not shown in FIG. 3) for hanging the picture frame assembly from a nail or hanger device as previously discussed. The tab 25 also provides a means for gripping the inner frame member in order to remove the inner frame member from gripping engagement with the outer frame member. By gripping one of the tabs 25 and pulling while holding the outer frame member, the inner frame member may be "unsnapped" from the outer frame member to enable the user to change or remove the picture unit 32 which is displayed within the picture frame assembly 10.

It will also be seen in FIG. 3 that the rounded face 15 of the outer frame member is offset inwardly by a slight distance. This offset enhances the appearance of the rounded face by providing an outside shoulder 18. It also causes the existence of an inside corner or shoulder 17. While outside shoulder 18 is aesthetic, inside shoulder 17 is utilitarian. Inside shoulder 17 provides a surface upon which the outside edge of the pane of glass 31 and the picture unit 32 can be supported and held between the inner and outer frame members.

The picture unit 32 which is shown in FIG. 3 will generally consist of an image sheet and a backing sheet or board. In addition, the picture unit 32 may include a matting which will be of a white or other solid color, and which will border the image sheet in order to emphasize the image being displayed. Additionally, more than one sheet of matting may be used. Accordingly, the thickness of various picture units 32 will vary. The inner frame member 22 only has two gripping teeth on the outside surface of the sidewall as shown in FIG. 3. However, the inner surface of the sidewall 13 of the outer frame member has a greater number of teeth, with six teeth 16 being shown in FIG. 3 for purposes of illustration. As the thickness of the picture unit 32 is varied, the position of the inner frame member 22 will vary within the outer frame member. Thus, when the picture unit thickness is thinner, the inner frame member will be nested deeper within the outer frame member. In contrast, if the picture unit 32 is thicker, the inner frame member will have the teeth in gripping engagement in a location which nests the inner frame member less deeply within the outer frame member. Thus, the picture frame assembly is self-adjusting to allow for the variation of thickness which may occur in the picture unit that is being displayed.

Although the picture frame assembly of the present invention which has been illustrated in FIGS. 1, 2 and 3 has a rectangular shape, those skilled in the art will recognize that a shape other than rectangular could be used. For example, the shape of the picture frame assembly could be circular or oval, or it could be hexagonal or octagonal as might be desired. The picture frame assembly will be preferably fabricated of a thermoplastic polymer by high pressure injection molding. It is preferred that the thermoplastic polymer be a high impact polystyrene and that it may contain up to 10% of crystalline polystyrene in order to impart a sheen. The thermoplastic polymer may also contain pigments or dyes which can provide various colors to suit the needs of the user.

In light of the foregoing disclosure, further alternative embodiments of the inventive picture frame assembly will undoubtedly suggest themselves to those skilled in the art. It is thus intended that the disclosure be taken as illustrative only, and that it not be construed in any limiting sense. Modifications and variations may be resorted to without departing from the spirit and scope of this invention, and such modifications and variations are considered to be within the purview and the scope of the appended claims.

The invention claimed is:

1. A picture frame assembly, comprising:

(a) an outer frame member having a peripheral sidewall including two long sidewalls and two short sidewalls to encompass a framed picture unit and having a peripheral face for covering the outer circumferential portion of a framed picture unit;

(b) an inner frame member sized and shaped to fit snugly within the peripheral sidewall of the outer frame member, said inner frame member having a peripheral sidewall including two long sidewalls and two short sidewalls, said peripheral sidewall being channel shaped, having first and second legs in parallel spaced relationship to each other, said legs defining a peripheral face for pressing a framed picture unit against the back of the peripheral face of the outer frame member;

(c) a plurality of gripping means on the inside surface of the peripheral sidewall of the outer frame member and a like plurality of gripping means on the outside surface of the peripheral sidewall of the inner frame member, one of said gripping means being centrally located on each of said short sidewalls of said inner and outer frame members and two of said gripping means being located at upper and lower ends of each of said long sidewalls of said inner and outer frame members, said gripping means on said outer frame member being disposed to engage said gripping means on said inner frame member for coacting to releasably secure said inner frame member to said outer frame member when said inner frame member is fit within said outer frame member to hold a picture unit therebetween;

(d) a plurality of recesses in the sidewall surface of said inner frame member, said plurality of recesses containing therein the plurality of gripping means on said inner frame member to thereby provide a snug fit of said inner frame member within said outer frame member when said frame members are secured together;

(e) each of said gripping means including a set of gripping teeth, said teeth being in side-by-side relationship to each other and in longitudinal alignment with the respective peripheral sidewall of said inner and outer frame members, said teeth in said recesses in said inner frame member being configured so that a point of each said tooth is coplanar with an outside surface of the corresponding sidewall; and, (f) said inner frame member including a plurality of tabs spaced about the inner surface of the peripheral sidewall on both said long and short sidewalls, said tabs projecting from said inner surface and being spaced away from the peripheral face of said inner frame member, and said tabs having a serrated edge for providing several points of support for said picture frame assembly upon a hanger device.

2. A picture frame assembly according to claim 1 further including a pane of glass sized and shaped to fit within the peripheral sidewall of the outer frame member and to be secured between the inner and outer frame members when said inner frame member is fit within said outer frame member and releasably secured thereto.

3. A picture frame assembly, suitable for framing photographs, water colors, posters, which comprises:

(a) an outer frame member having a peripheral sidewall including two long sidewalls and two short sidewalls to encompass a framed picture unit and having a peripheral face for covering the outer circumferential portion of a framed picture unit;

(b) an inner frame member sized and shaped to fit snugly within the peripheral sidewall of the outer frame member, said inner frame member having a peripheral sidewall including two long sidewalls and two short sidewalls, said peripheral sidewall being channel shaped, having first and second legs in parallel spaced relationship to each other, said legs defining a peripheral face for pressing a framed picture unit against the back of the peripheral face of the outer frame member;

(c) a plurality of first gripping means spaced about the inside surface of the peripheral sidewall of the outer frame member, one of said gripping means being centrally located on each of said short sidewalls of said inner and outer frame members and two of said gripping means being located at upper and lower ends of each of said long sidewalls of said inner and outer frame members, said gripping means on said outer frame member being disposed to engage said gripping means on said inner frame member, said plurality of first gripping means each including a set of longitudinally aligned gripping teeth in side-by-side relationship;

(d) a plurality of second gripping means spaced about the outside surface of the peripheral sidewall of the inner frame member, said second gripping means being sized, shaped and positioned on said inner frame member to releasably grippingly engage said first gripping means on said outer frame member when said inner frame member is fitted within said outer frame member to releasably secure a picture unit between said inner and outer frame members;

(e) a plurality of recesses in the sidewall surface of said inner frame member, said plurality of recesses containing therein the plurality of gripping teeth on said inner frame members to thereby provide a snug fit of said inner frame member within said outer frame member when said frame members are secured together;

(f) said second gripping means comprising a plurality of sets of elongated gripping teeth contained within said recesses, each said set containing a plurality of gripping teeth terminating at the outside surface of the peripheral sidewall of the inner frame member positioned in side-by-side orientation; and (g) said inner frame member including a plurality of tabs spaced about the inner surface of the peripheral sidewall on both said long and short sidewalls, said tabs projecting from said inner surface and being spaced away from the peripheral face of said inner frame member, and said tabs having a serrated edge for providing several points of support for said picture frame assembly upon a hanger device.

4. A picture frame assembly according to claim 3 further including a pane of glass sized and shaped to fit within the peripheral sidewall of the outer frame member and to be secured between the inner and outer frame members when said inner frame member is fit within said outer frame member and releasably secured thereto.

5. A picture frame assembly, comprising:

(a) an outer frame member having a peripheral sidewall including a pair of short sidewalls and a pair of long sidewalls to encompass a framed picture unit and having a peripheral face for covering the outer circumferential portion of a framed picture unit;

(b) an inner frame member sized and shaped to fit snugly within the peripheral sidewall of the outer frame member, said inner frame member having a peripheral sidewall including a pair of short sidewalls and a pair of long sidewalls, and having a peripheral face being channel shaped with first and second legs for pressing a framed picture unit against the back of the peripheral face of the outer frame member;

(c) a plurality of first gripping means spaced about the inside surface of the peripheral sidewall of the outer frame member, a pair of said gripping means on each of said long sidewalls and a single gripping means centrally located on each of said short sidewalls of said outer frame member, said first gripping means comprising a plurality of sets of elongated gripping teeth, each set of elongated gripping teeth containing a plurality of gripping teeth projecting above the inner surface of said sidewall in longitudinal alignment with the edge of said peripheral sidewall and positioned in side-by-side orientation;

(d) a plurality of second gripping means spaced about the outside surface of the peripheral sidewall of the inner frame member, a pair of said gripping means on each of said long sidewalls and a single gripping means centrally located on each of said short sidewalls of said inner frame member, said second gripping means being sized, shaped and positioned to releasably grippingly engage said first gripping means on said outer frame member when said inner frame member is fitted within said outer frame member, said second gripping means comprising a plurality of sets of elongated gripping teeth spaced about the outside surface of the peripheral sidewall of the inner frame member, each set of elongated gripping teeth containing a plurality of gripping teeth disposed in side-by-side relationship to each other at the outer surface of said sidewall in longitudinal alignment with the edge of said peripheral sidewall, and each set of teeth on said inner frame member being located to engage a set of teeth on said outer frame member in gripping engagement;

(e) a plurality of recesses in the sidewall outside surface of said inner frame member, said plurality of recesses containing therein the plurality of gripping teeth on said inner frame member, with said gripping teeth projecting from the bottom surface of each said recess so that a point of each of said teeth is coplanar with said outer surface of the peripheral sidewall of said inner frame member to thereby releasably secure said inner frame member to said outer frame member in a snug fit when said frame members are secured together; and (f) said inner frame member including a plurality of tabs spaced about the inner surface of the peripheral sidewall on said short and long sidewalls, said tabs projecting from said inner surface and being spaced away from the peripheral face of said inner frame member, and said tabs having a serrated edge for providing several points of support for said picture frame assembly upon a hanger device.

6. A picture frame assembly according to claim 5 wherein said inner frame member includes a plurality of tabs spaced about the inner surface of the peripheral sidewall, said tabs projecting from said inner surface and being spaced away from the peripheral face of said inner frame member, and said tabs having a serrated edge for supporting said picture frame assembly upon a hanger device.

* * * * *